US005253605A

United States Patent [19]

Collins

[11] Patent Number: 5,253,605

[45] Date of Patent: Oct. 19, 1993

[54] METHOD AND APPARATUS FOR DEPLOYING AND RECOVERING WATER BORNE VEHICLES

[75] Inventor: Kenneth D. Collins, San Diego, Calif.

[73] Assignee: Applied Remote Technology, Inc., San Diego, Calif.

[21] Appl. No.: 994,289

[22] Filed: Dec. 21, 1992

[51] Int. Cl.[5] ..... B63B 21/66

[52] U.S. Cl. ..... 114/259; 114/258

[58] Field of Search ..... 114/71, 72, 205, 244, 114/258, 259, 365, 366, 375

[56] References Cited

U.S. PATENT DOCUMENTS

| | | | |
|---|---|---|---|
| 1,111,836 | 9/1914 | Johnson et al. | 114/366 |
| 2,398,274 | 4/1946 | Alberg | 114/259 |
| 2,730,864 | 1/1956 | Parker | 114/366 |
| 3,572,513 | 3/1971 | Tantlinger et al. | 212/205 |
| 3,596,623 | 8/1971 | Frankel | 114/259 |
| 3,942,737 | 3/1976 | Luzi | 114/244 |
| 3,943,875 | 3/1976 | Sanders | 114/244 |
| 4,138,961 | 2/1979 | Roper | 114/72 |
| 4,462,330 | 7/1984 | Campbell et al. | 114/244 |
| 4,658,750 | 4/1987 | Malcosky | 114/366 |
| 4,732,103 | 3/1988 | Culbertson | 114/71 |
| 4,876,979 | 10/1989 | Walton et al. | 114/258 |
| 4,898,112 | 2/1990 | McGlew et al. | 114/259 |

*Primary Examiner*—David M. Mitchell
*Assistant Examiner*—Stephen P. Avila
*Attorney, Agent, or Firm*—Frank D. Gilliam

[57] ABSTRACT

Method for launching and recovering a water borne vehicle from a surface ship in water having a turbulent surface while the surface ship is drifting or underway. The water borne vehicle is stored in a portable standard container van which is generally stored on land when not in use and attached to the deck of the surface ship when the vehicle is to be deployed. The container van has a bottom surface supporting a plurality of rollers which allow the vehicle to be translated therealong from a stowed position to a launch position wherein the nose of the vehicle rests on the rollers and the rear of the vehicle rests on a roller assembly which is pivotly attached to the stern of the surface ship, an overhead gantry crane with its lifting cable attached to the nose of the vehicle, rotates the vehicle about the pivotal attachment to the surface ship to emerge the rear of the vehicle into the water for stability, translates the vehicle rearwardly with the nose remaining in the air and the rear portion in the water to a launch position with the nose now positioned over the water and spaced from the stern of the surface ship and then lowers the nose of the vehicle into the water to complete the launch. The recovery of the vehicle is accomplished by reversing the launch procedure. The vehicle after launch can be tethered to the cable or released therefrom. If the vehicle is detached from the cable for launch then it must be reattached to the cable prior to the recovery procedure.

6 Claims, 2 Drawing Sheets

METHOD AND APPARATUS FOR DEPLOYING AND RECOVERING WATER BORNE VEHICLES

BACKGROUND OF THE INVENTION

The prime consideration in recovery and deployment of water borne vehicles, both underwater and surface types, is to prevent damage to those vehicles, the recovery surface ship or personnel involved. Typical apparatus currently employed for this purpose include the of placing the vehicle in a sling while it is suspended from a ship mounted or floating crane. This procedure may subject the vehicle to damage from wave action forces generated by rough seas and from passage of the exposed vehicle through the interface between the ocean and the atmosphere. Damage may also result as the sling responds to rough seas causing the vehicle to be slammed against the structure of the recovery ship. Other systems include a single-point launch and recovery systems. Most of these type systems employ overboarding hoists or A-frames with a high strength line that lifts the underwater equipment to/from the water and the ship's deck. There are some basic problems related to this type system, namely, the ship generally must be stopped in the water, the ship's motion in the water differs from the motion of submerged equipment, there is dangerous swinging of the equipment taken from the water or entering the water. Some motion compensation systems and single-axis, anti-swing mechanisms have been developed to mitigate one or more of the above problems. Such devices are complex, heavy, expensive and do not always operate well specifically with long slender vehicles.

U.S. Pat. No. 4,876,979 by inventors Walton et al. teaches an apparatus for deploying and retrieving a seaborne vehicle having a frangible surface that includes a muzzle and a cylindrical shaped cocoon. The muzzle is clamped to the vehicle and then pulled by a rope into the cocoon. Bladders within the cocoon are inflated with pressurized air to grip the vehicle. The vehicle can then be safely retrieved by hoisting the cocoon out of the ocean. Vehicle deployment is achieved by placing the vehicle in the cocoon, pressurizing the bladders with air, lowering the cocoon and attendant vehicle into the ocean, exhausting the air from the bladders and towing the cocoon so that water passing apertures in the bow of the cocoon push the vehicle into the open ocean.

The conventional methods and the method in the above reference patent have their obvious disadvantages, namely, the conventional method and apparatus cannot be used when the water surface is not smooth and the patented apparatus and method is complex and costly to implement, must be configured to a specific vehicle and components must be stored when not in use.

There is a long standing need for apparatus and method for recovering and deploying water vehicles that prevents damage to the recovered or deployed vehicle and the attendant vehicle in rough water surface environments.

SUMMARY OF THE INVENTION

The present invention is directed to an improved deployment and recovery system for a water borne vehicle being launched from or recovered by a surface ship under rough surface water conditions. The water borne vehicle such as, a tethered or untethered underwater vehicle, is stored when not in use in a portable standard container van. The container van includes an internal gantry crane for support, launching and recovering of the water borne vehicle. The container van is suitable for transport with the water borne vehicle secured inside. The container van can be transferred from a land location to the deck of a surface ship and secured to the deck for water borne vehicle launch and recovery.

The launch recovery system includes a roller assembly pivotly attached to the stern of the surface ship. The container van includes a plurality of rollers on the floor or bottom surface thereof which are at the same elevation as the roller assembly when the roller assembly is parallel to the plurality of rollers. The container van is positioned on the surface ship deck so that the pivot roller assembly is lined up both horizontally and vertically with the container van plurality of rollers.

To accomplish the launch of the water borne vehicle, the vehicle is manually or by way of driven rollers within the plurality of container van rollers moved aft from its container van stowed position until the bow or nose of the vehicle is aligned with the aft end of the gantry crane and the stern or tail of the water borne vehicle slides onto the stern pivot roller assembly with the main weight of the water borne vehicle is still centered over the plurality of van rollers, the cable from the crane is released sufficiently to be attached to the nose of the vehicle, the cable from the crane now attached to the nose of the vehicle is shortened until the bow of the vehicle is two-blocked (hard against) or close to the end of the crane's final sheave with the water borne vehicle's stern weight being carried by the stern pivot roller assembly, which must pivot as the nose is raised. The crane is then moved aft relative to the container van and the stern of the surface ship with the tail or stern of the water borne vessel rolling along the stern pivot roller assembly causing the vehicle to gradually rotate on the roller assembly relative to the roller pivot connection to the surface ship until the tail of the vehicle contacts and partially submerges into the water. At the point of contact with the water if the ship is underway, the moving water begins to pull the vehicle away from the roller assembly as the gantry continues to translate aft to its maximum aft position with the vehicle well clear of the stern of the surface ship. However, any pitching or shifting of the surface ship will not cause harm to the vehicle because the vehicle is partially submerged in the water at this position will not swing dangerously free. The cable from the crane can now be extended to release the vehicle from a two-blocked or nose tight position against the end of the crane position and into the water to complete the launch. The cable end can be either tethered to or disconnected from the water borne vehicle.

The recovery of the vehicle from the water is in effect the reverse of the launch sequence. The crane is in its maximum aft vehicle launch control position, the vehicle is again attached to the crane cable if not tethered thereto and then pulled upward by shortening the length of the cable until the nose is again two-blocked to the end of the crane, the crane is moved forward until the vehicle rests upon the pivot roller assembly, the crane continues to move forward pulling on the nose until the center of gravity of the vehicle passes forward of the pivot roller assembly causes the nose of the vehicle to pivot downwardly, at this position the cable of the crane is extended to allow the vehicle to encounter the plurality of rollers in the container van and at which time the roller assembly is pivoted to the same plane as the plurality of rollers. The vehicle is then released from the crane and manually or power roller moved forward to its stowed repair, cleaning and storage position within the container van.

There are a number of well ways well known in this art to reconnect the crane cable to the nose of the water borne vehicle on recovery of the vehicle.

An object of this invention is to provide a method of launching and recovering a water borne vehicle from a surface ship while that ship is underway or drifting in substantially any water surface condition without causing damage to the water borne vehicle or to the surface ship.

Another object of this invention is during launch to maintain the water borne vehicle in substantially a horizontal position and rotating the vehicle into a vertical position allowing the stern of the vehicle to be submerged into the water while maintaining positive contact with the surface ship until the vehicle is spaced from the stern of the surface ship thereby preventing damaging contact between the vehicle and surface ship during vehicle launch.

These and other objects and advantages of the present invention will become apparent to those skilled in the art after considering the following detailed specification in which the preferred embodiment are described in conjunction with the accompanying drawing Figures.

DETAILED DESCRIPTION OF THE PREFERRED EMBODIMENT

Figure 1:
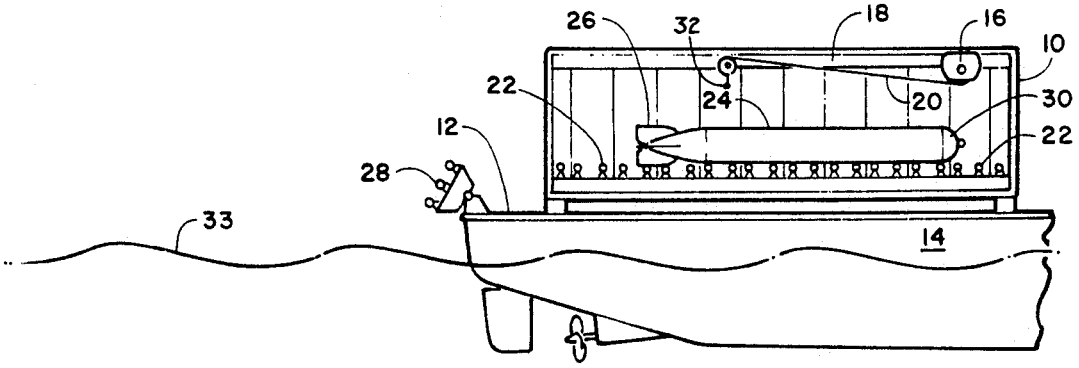
FIG. 1 is a schematic showing depicting the surface ship, container van and water borne vehicle.

Referring now to the various drawing Figures which depict the vehicle launching and recovery sequence of the present invention. The drawing Figures depict a portable container van 10 with the wall closest to the viewer removed for the purpose of discussion to expose the contents thereof. The container van is shown secured to the deck 12 of a surface ship 14.

Figure 6:
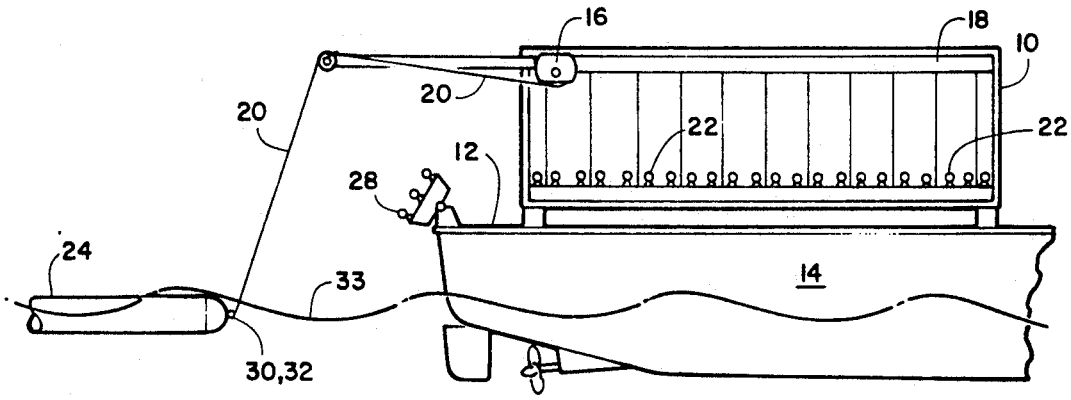
FIG. 6 is a showing similar to the previous Figures with the vehicle nose lowered to the water surface.

The portable container van 10 includes an overhead mounted gantry crane 16 which travels back and forth from a FIG. 1 position to a FIG. 6 position along a track 18 which extends from the back to the front of the container van. The crane includes a cable 20 which extends and retracts in a conventional known and expected manner. The bottom surface of the container van includes a plurality of rollers 22 either free rotating or some of which are free rolling and others which may be driven.

In FIG. 1, a water borne vehicle 24 either of the submergible or surface type is shown in a stowed position resting upon the plurality of rollers 22 within the van container 10. The gantry crane 16 is in its container van forward most position.

Figure 2:
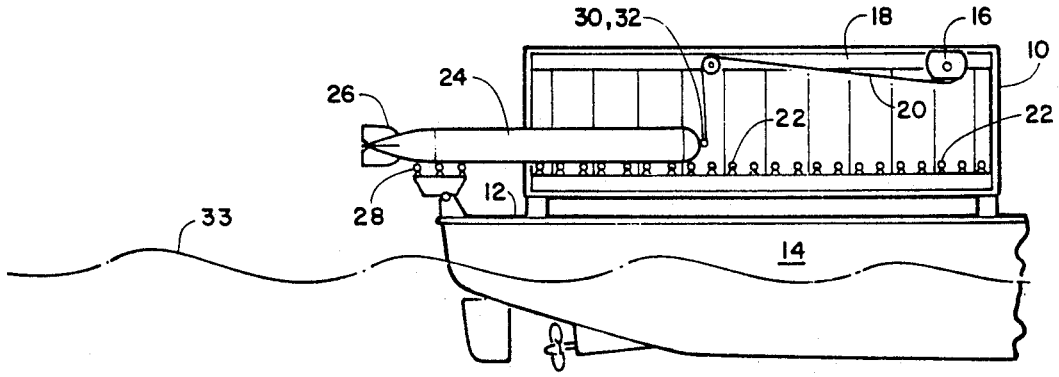
FIG. 2 is a showing similar to the previous FIG. 1 showing with the vehicle moved aft within the container van for connection to the lifting cable of a gantry crane.

As shown in drawing FIG. 2, the water borne vehicle 24 has been translated aft within the container van along the plurality of rollers 22 to an intermediate position partially within and partially outside of the end of the container van. In this position, the stern or rear portion 26 of the vehicle is resting on a roller assembly 28 which is pivotly mounted to the stern of the surface ship 14. The front tip or nose 30 of the vehicle 24 is attached to the end 3 of the cable 18 which has been extended from the end of the crane sufficiently for nose tip attachment.

Figure 3:
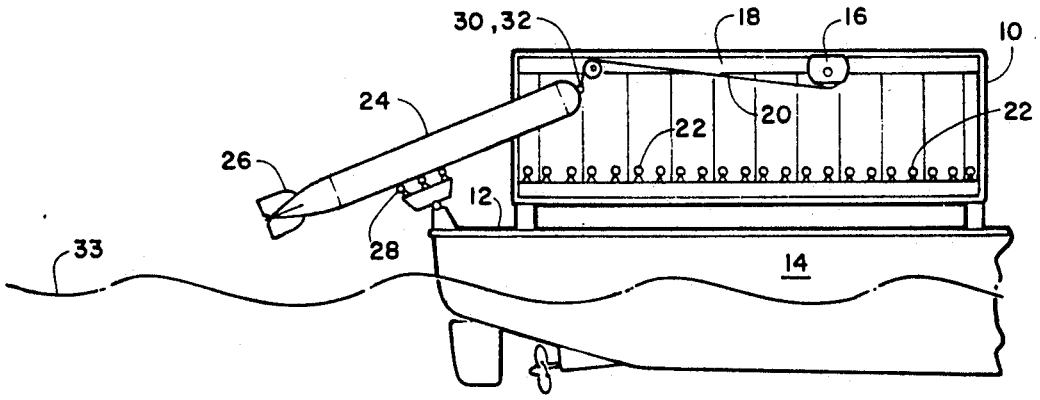
FIG. 3 is a showing similar to the previous Figures showing with the nose of the vehicle elevated to the crane end.

As shown in drawing FIG. 3, the nose of the vehicle has been elevated by shortening the end of the cable distance from the end of the crane. The elevating of the nose of the vehicle allows the vehicle to rotate relative to the stern of the surface ship while resting on the roller assembly 28 thereby placing the stern or rear portion of the vehicle closer to the water surface 33.

Figure 4:
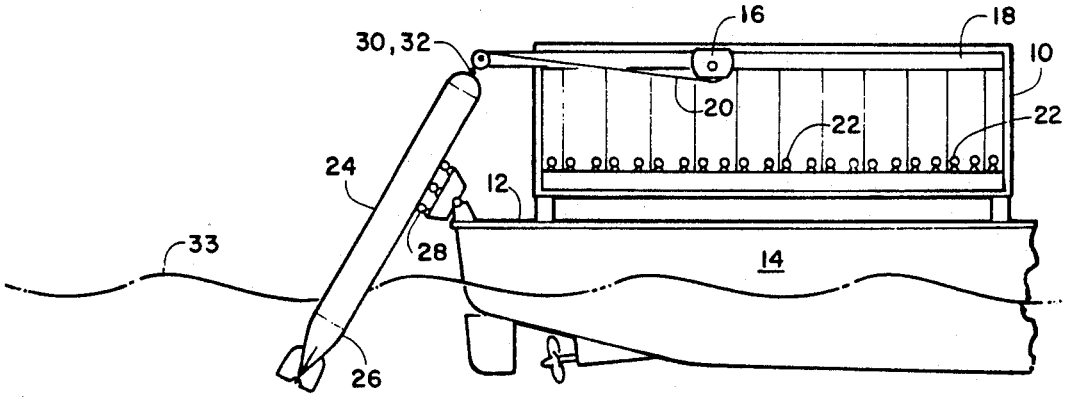
FIG. 4 is a showing similar to the previous Figures with the gantry moved aft to where the vehicle is rotated to a position were the stern penetrates the water surface.
Figure 5:
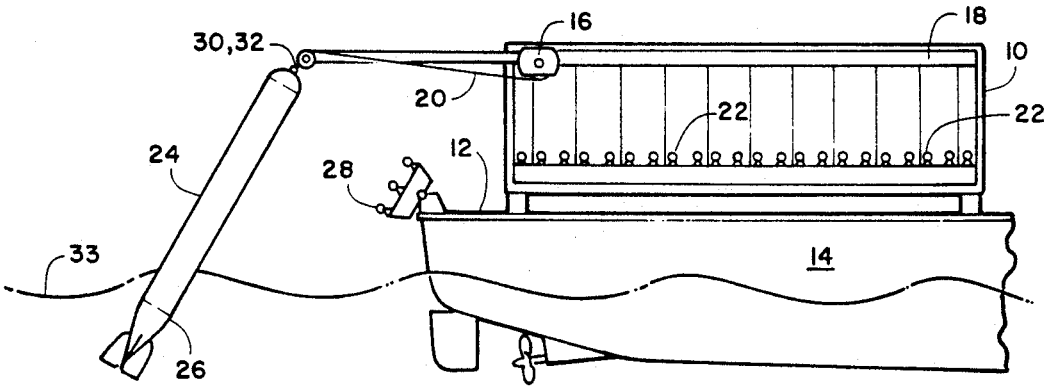
FIG. 5 is a showing similar to the previous Figures with the crane extended over the water beyond the stern of the surface ship with the vehicle nose tight against the end of the crane.

As can be seen in drawing FIG. 4, after the crane is in the drawing FIG. 3 position, the crane is moved aft allowing further rotation of the vehicle and the placement of its stern or rear portion into the water.

As the crane is moved further rearward, the vehicle clears the stern of the surface ship minimizing the chance of contact between the vehicle and the surface ship regardless of the surface condition of the water or the relative movement between the vehicle and surface ship.

In the FIG. 6 showing, the nose of the vehicle has been lowered by extending the end of the cable to the position shown. The launch of the vehicle has now been completed.

It should be understood that the surface ship can be underway, i.e. moving forwardly in the water, or drifting during any of the above sequence of launching events.

The vehicle can be either operated for its intended use while attached to the end of the cable or while free from the cable end.

The recovery of the vehicle is accomplished by the reversing of the above sequence of launching events briefly stated as follows: Extending the gantry crane beyond the deck of the surface ship to a maximum crane rearward translation position; Extending the cable from the crane for attachment to the nose of said vehicle, if the vehicle is detached; Elevating the nose of the vehicle to substantially the cable maximum elevated position; Pivoting the vehicle relative to the deck of the surface ship about the roller assembly while translating the gantry crane away from the maximum crane rearward position to its maximum forward position; Extending the cable length allowing the vehicle to become horizontal within the container van; Disconnecting the end of the cable from the forward surface of the vehicle; and Moving the vehicle along the plurality of rollers to its stowed position within the container van.

The container van is constructed so as to allow movement of the container van and vehicle from a land based storage/repair area to the deck of a surface ship without any expected damage to the vehicle or container van. The walls and roof of the container van support the gantry crane and protect the vehicle from the environment during vehicle maintenance, repairing, etc.

Although the method and apparatus for launching the water borne vehicle as been described as occurring from the stern of the surface ship, it should be understood that the water borne vehicle can be launched equally as well from the side of the deck of the surface ship in a similar manner as described in the stern launch.

While specific embodiments of the method and apparatus for launching and recovery of a water borne vehicle from a surface ship have been shown and fully explained above for the purpose of illustration it should be understood that many alterations, modifications and substitutions may be made to the instant invention disclosure without departing from the spirit and scope of the invention as defined by the appended claims.

What is claimed is:

1. A method of launching a water born vehicle into a rough water surface, said vehicle having a front and rear surface and positioned within a portable container van secured to the deck of a surface ship comprising the steps of:

moving the vehicle from a stowed position within said container van a finite distance to a position where said rear surface of said vehicle extends over said water beyond said deck;

attaching said front surface of said vehicle to the end of an extendable and contractible cable supported by a translatable gantry crane;

elevating the front surface of said vehicle with said cable causing the rear surface of said vehicle to penetrate the rough water surface;

moving the front surface of said vehicle rearwardly beyond the deck of said surface ship while said forward surface remains elevated by translating said translatable crane; and lowering the forward surface of said vehicle into the water after said vehicle is positioned over said water spaced from said surface ship by extending said cable toward said water.

2. The method of launching a vehicle as defined in claim 1 further comprising the step of initially moving said portable container van and said vehicle from a land based storage area to said deck of said surface ship.

3. The method of launching a vehicle as defined in claim 1 including the additional step of moving said surface ship through said water during at least a portion of vehicle launch.

4. A method of recovering a water born vehicle from a rough water surface for storage within a portable container van secured to the deck of a surface ship, said vehicle having a front and rear surface comprising the steps of:

extending a gantry crane beyond said deck of said surface ship from said container van to a maximum crane extended translation position over said water spaced from said surface ship's deck;

extending a cable from said crane for attachment to the forward surface of said vehicle;

elevating the forward surface of said vehicle to substantially the cable maximum retracted position;

pivoting said vehicle relative to the deck of said surface ship while translating said crane away from said maximum crane position in an opposite direction to its maximum stowed position;

extending said cable for allowing said vehicle to become horizontal within said container van;

disconnecting said cable from the forward surface of said vehicle; and moving said vehicle to its stowed position within said container van.

5. The method of recovering a vehicle as defined in claim 4 further comprising an additional step of moving said portable container van and vehicle from said deck of said surface ship to a land based storage area.

6. The method of recovering a vehicle as defined in claim 4 including the additional step of moving said surface ship through said water during at least a portion of vehicle recovery.

* * * * *